US006307507B1

(12) United States Patent
Gross et al.

(10) Patent No.: US 6,307,507 B1
(45) Date of Patent: Oct. 23, 2001

(54) SYSTEM AND METHOD FOR MULTI-MODE OPERATION OF SATELLITE PHASED-ARRAY ANTENNA

(75) Inventors: Joel Lloyd Gross, Chandler; Jonathan Henry Gross, Gilbert, both of AZ (US); Robert Anthony Peters, Silver Spring; Daniel Francis DiFonzo, Rockville, both of MD (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/519,915

(22) Filed: Mar. 7, 2000

(51) Int. Cl.[7] ..... H01Q 3/26
(52) U.S. Cl. ..... 342/373; 342/354; 342/372
(58) Field of Search ..... 342/81, 354, 368, 342/372, 373, 154

(56) References Cited

U.S. PATENT DOCUMENTS

| | | | | |
|---|---|---|---|---|
| 5,532,706 | * | 7/1996 | Reinhardt et al. | 343/778 |
| 5,739,784 | | 4/1998 | Jan et al. | 342/354 |
| 5,808,967 | * | 9/1998 | Yu et al. | 367/91 |
| 5,856,804 | | 1/1999 | Turcotte et al. | 342/371 |
| 5,923,289 | | 7/1999 | Buer et al. | 342/373 |
| 5,929,809 | | 7/1999 | Erlick et al. | 342/372 |
| 5,969,675 | | 10/1999 | Erlick | 342/373 |
| 5,977,907 | | 11/1999 | Gross | 342/354 |
| 6,084,545 | * | 7/2000 | Lier et al. | 342/360 |
| 6,114,994 | * | 9/2000 | Soref et al. | 342/372 |
| 6,163,296 | * | 12/2000 | Lier et al. | 342/417 |

* cited by examiner

*Primary Examiner*—Dao Phan
(74) *Attorney, Agent, or Firm*—Frank Bogacz

(57) ABSTRACT

A method and apparatus are provided for operating a phased-array antenna (14) on a satellite-based communications node (10) in more than one mode by controlling the number of beam-forming elements and by applying appropriate phase-control and/or amplitude-control coefficients to the selected elements. The antenna can be operated as a diffused-beam antenna at a relatively low data rate, enabling the satellite-communications node (10) to communicate with a first terrestrial communications node (22). The antenna can also be operated to generate multiple focused-beam antenna patterns each communicating at a relatively high data rate, enabling the satellite-communications node (10) to communicate with a different terrestrial communications node (20) by changing the amplitude and/or the phase coefficients as well as the number of beam-forming elements.

12 Claims, 4 Drawing Sheets

SYSTEM AND METHOD FOR MULTI-MODE OPERATION OF SATELLITE PHASED-ARRAY ANTENNA

FIELD OF THE INVENTION

This invention relates generally to satellite-based communications systems and, in particular, to systems and methods for operating a satellite-based phased-array antenna in more than one mode.

BACKGROUND OF THE INVENTION

In some satellite communications systems, satellite-based communications nodes, such as low-earth orbit (LEO) satellites, communicate with one another and with terrestrial communications nodes, such as gateway terminals, wireless devices, and tracking, telemetry, and control (TT&C or TTAC) stations.

LEO satellites typically utilize different types of on-board antennas to communicate with different types of communications nodes within the satellite communications system. For example, a satellite-based phased-array antenna can be used for communications with earth-based wireless devices such as satellite telephones and pagers, whereas an omni-directional antenna is often used for communications with TT&C stations during the initial ascent phase and in a temporary orbital parking phase prior to the satellite's deployment to its final orbit. Parabolic antennas, and other types of antennas, are often used for other communications links, such as for inter-satellite links (cross-links) to and from neighboring satellites and for feeder links to and from gateway terminals that link the satellite signals with wired communications infrastructure such as terrestrial communications networks.

There are several disadvantages to using antennas of different types on-board a communications satellite. These include: additional mass and volume; additional cost and time to design, build and/or purchase, integrate, test, launch, and maintain the satellite's antenna systems; additional complexity of the satellite; additional power consumption; and the difficulties in antenna system layout on the satellite to avoid the situation where one antenna can block communications signals being sent to or from another antenna on the satellite.

Accordingly, there is a significant need for systems and methods that can reduce the number and types of separate antennas required on a communications node such as a satellite.

There is also a significant need for systems and methods that can operate a single phased-array antenna on a satellite-based communications node in more than one mode.

There is also a significant need for a satellite-based communications system that can communicate with different types of terrestrial communications nodes, using at least two different modes of operation, one mode having a diffused beam pattern and using a communications channel having a relatively low bandwidth, and another mode having a focused beam pattern and using a communications channel having a relatively high bandwidth.

There is a further significant need for a satellite-based communications system having a phased-array antenna that can communicate using at least two different modes of operation, in which at least one data structure, including phased-array antenna data such as antenna coefficients, is stored in an on-board computer-readable medium or memory and is used to control the antenna to operate in the at least two modes.

BRIEF DESCRIPTION OF THE DRAWINGS

The invention is described with particularity in the appended claims. However, other features of the invention will become more apparent and the invention will be best understood by referring to the following detailed description in conjunction with the accompanying drawings in which:

DETAILED DESCRIPTION OF THE DRAWINGS

Figure 1:
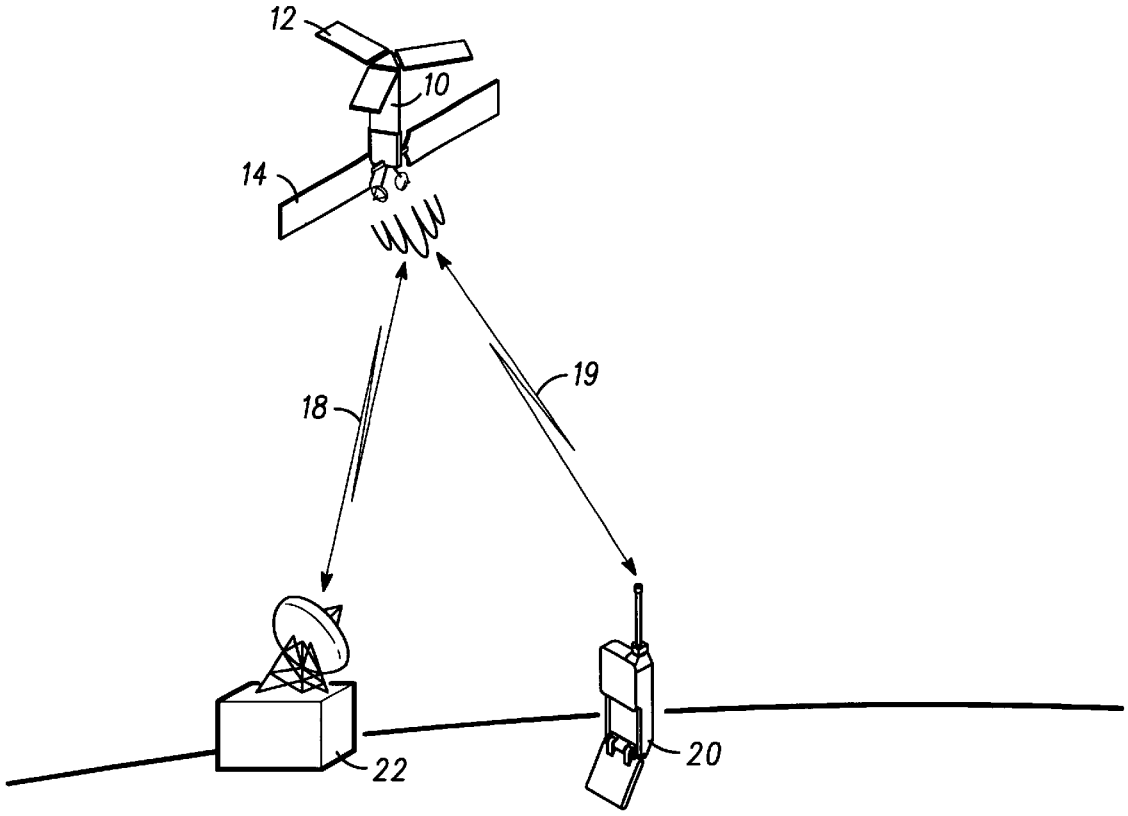
FIG. 1 depicts a simplified diagram of a satellite communications system, including a satellite-based communications node having an antenna that operates in more than one mode, according to one embodiment of the invention.

In the following detailed description of the preferred embodiments, reference is made to the accompanying drawings that form a part hereof, and in which are shown by way of illustration specific embodiments in which the invention can be practiced. It is to be understood that other embodiments can be utilized and structural changes can be made without departing from the scope of the present invention.

As used herein, the term "antenna pattern" is not intended to be limited to any particular mode of generation and includes those patterns created by either terrestrial or satellite cellular communications systems and/or combinations thereof.

A "satellite" is used herein to mean an orbiting wireless communications device which can be located in any orbit including, but not limited to, low-earth orbit (LEO), medium-earth orbit (MEO), high-earth orbit (HEO), or geosynchronous orbit (GEO). It will be understood that the invention can also be used on terrestrial phased-array antennas and on space vehicles that are not orbiting a planetary body.

A "terrestrial communications node" is used herein to mean any wireless communications device which is located proximate to, above, or below the surface of the earth; a ground station, such as a gateway for coupling to a public switched telephone network (PSTN) or other terrestrial network; a tracking, telemetry, and control (TTAC) station; or the like.

A "wireless communications device" is used herein to mean any device that communicates without hard-wired connections, including but not limited to cellular telephones, pagers, hand-held computer and other data devices, satellites, radios, and any other optical, radio frequency (RF), or non-hardwired communication device.

According to one embodiment of the invention, method and apparatus are provided for operating a phased-array antenna in one or more of a plurality of modes. A computer determines a desired mode of operation by retrieving mission phase data from memory. The computer controls a beamformer of the phased-array antenna to cause the phased-array antenna to operate in the desired mode of operation. According to other embodiments, the phased-array antenna can be operated simultaneously (or concurrently) in more than one mode.

For example, if the phased-array antenna is on-board a communications satellite, the computer retrieves data from a memory, including spacecraft status data, to determine, for example, whether the spacecraft is in an ascent phase, a parking orbit phase, a mission phase in its ultimate orbit, or in any other phase.

Depending upon the particular spacecraft status, the computer retrieves antenna data from the computer and sends it to the phased-array antenna. The antenna data is applied to various portions of the phased-array antenna, such as a digital beamformer and an element controller, which use the antenna data to control the functional mode of the phased-array antenna.

For example, if the spacecraft is in an ascent phase, it needs to communicate with a terrestrial communications node, such as a tracking, telemetry, and control (TTAC) station, to receive various control instructions to eventually place the spacecraft in its ultimate, mission orbit. Due to a degree of uncertainty as to the spacecraft's precise position and orientation, this communication is typically performed using an omni-directional ("omni") antenna in known prior satellite communications systems. However, in the present invention, this communication is performed using an on-board phased-array antenna operating in "omni" mode, wherein the antenna beam pattern is relatively broad or diffuse and operates at a relatively low data rate.

If the spacecraft is traveling in its mission orbit performing its intended mission operations by communicating with a plurality of wireless communications devices, this type of communication is performed by the methods and apparatus of the present invention using the phased-array antenna in a "mission" mode, by employing one or more individual antenna beam patterns, each being relatively focused and providing a relatively high data rate.

Other modes, to be described below, of operating the phased-array antenna can be used to satisfy the communications needs of the spacecraft when it is in other phases. In general, it is desirable if the frequencies for the different modes are similar.

FIG. 1 depicts a simplified diagram of a satellite communications system, including a satellite-based communications node 10 having an antenna 14 that operates in more than one mode, according to one embodiment of the invention. Although FIG. 1 illustrates only one satellite, it can be part of a larger satellite communications system that includes many satellites.

In one embodiment, satellite-based communications node 10 is a spacecraft orbiting Earth and comprising a plurality of propulsion, power, navigation, and communications systems (not shown). Satellite-based communications node 10 includes a solar panel 12 for charging batteries (not shown) to provide electrical power for the on-board electrical equipment.

Figure 2:
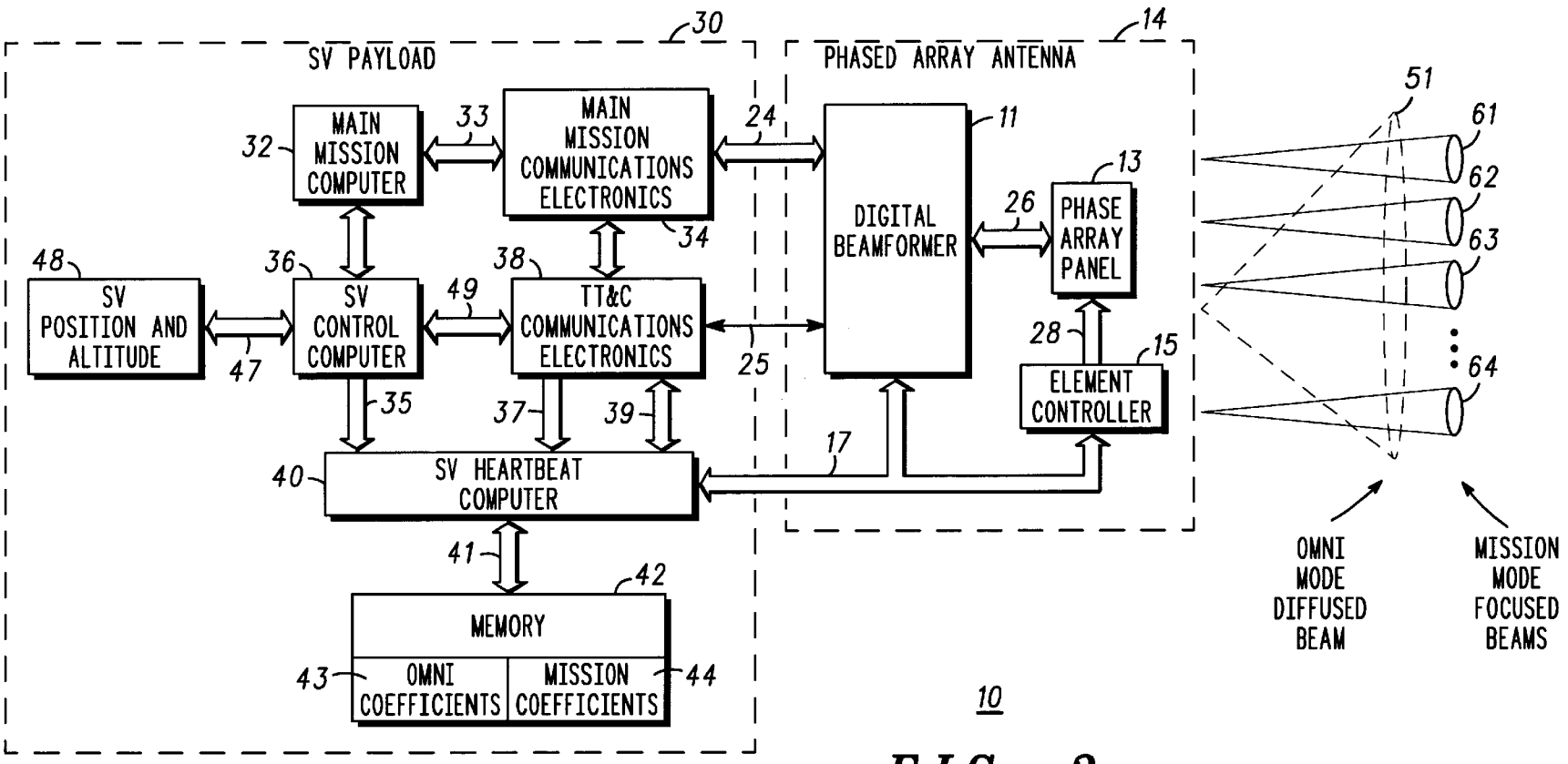
FIG. 2 depicts a simplified block diagram of a portion of a satellite-based communications node, including a phased-array antenna system that operates in more than one mode, according to one embodiment of the invention.

Satellite-based communications node 10 also comprises a phased-array antenna 14 generating a beam pattern 16. While only one phased-array antenna 14 is shown in FIGS. 1 and 2, it will be understood that separate phased-array antennas 14 can be provided, one for receiving and one for transmitting communications signals.

Satellite-based communications node 10 can communicate concurrently with one or more wireless communications devices 20, only one of which is shown for ease of understanding. Satellite-based communications node 10 transmits digital data to and receives digital data from individual wireless communications devices 20. Additionally, satellite-based communications node 10 may utilize crosslinks (not illustrated) that interconnect other similar satellite-based communications nodes to each other and to other networks.

In a preferred embodiment, the radio link 19 between satellite-based communications node 10 and wireless communications device 20 is a substantially wide-band data link capable of conveying digitized information, such as Internet data, digitized audio, digitized video, facsimile, or other information at a given data rate. While reference is made herein to digitized data, it will be understood by one of ordinary skill in the art that the present invention can be used with a phased-array antenna transmitting and receiving any type of information, whether digital or analog.

Satellite-based communications node 10 can also communicate with one or more ground stations 22 via radio link 18 for various purposes, including transmitting and receiving bulk amounts of data to a communications system gateway that is connected to a wired communications network, and transmitting and receiving data to and from a ground station. Only one ground station 22 is shown in FIG. 1 for ease of understanding.

In a space-based communication system, wherein one or more communications nodes are orbiting satellites, it is advantageous to control the direction to which receive and transmit antenna beams are pointed due to the need to maximize the antenna gain in particular directions and thereby minimize the costly satellite resources of power and bandwidth. Digital beamformers are particularly well suited for generating pluralities of receive and transmit communication beams. The use of a digital beamformer in such a system allows the communications node to generate beams which service subscribers located within specific areas on the Earth's surface and steer these beams as the satellite moves relative to the subscribers. Beams can be created in specific directions and collapsed according to the particular demand on the satellite communications node at any given time. However, one of ordinary skill will appreciate that the present invention need not necessarily be used with a steered-beam antenna system.

FIG. 2 depicts a simplified block diagram of a portion of a satellite-based communications node 10, including a phased-array antenna system that operates in more than one mode, according to one embodiment of the invention. Communications node 10 includes a space vehicle (SV) payload portion 30 and a phased-array antenna 14. It will be appreciated by one of ordinary skill in the art that communications node 10 typically includes other systems and equipment (not shown), including navigation equipment, propulsion equipment, power equipment, and the like that are used to maintain it in proper orbit.

As mentioned earlier, it will be understood that while only one phased-array antenna 14 is depicted in FIGS. 1 and 2, separate phased-array antennas 14 can be provided for receiving and transmitting communications signals, in accordance with known practice.

Phased-array antenna 14, when operated as a transmit antenna, comprises a plurality of elements that transmit signals occupying a frequency bandwidth. Each element of transmit antenna 14 can be of any type or construction such as a dipole, monopole above a ground plane, patch, or any other conductive element which radiates an electromagnetic wave as a function of an electrical current present on the surface of the element. Additionally, each radiating element can also be of the aperture type such as a waveguide slot, horn, or any other type of non-conducting element which radiates an electromagnetic wave as a function of the electric field present within an aperture.

Phased-array antenna 14, when operated as a receive antenna, comprises a plurality of elements which receive signals which occupy a portion of the system bandwidth and which are similar to those of a phased-array antenna 14 operating in a transmit antenna. Receive and transmit functions can possibly share certain hardware elements within communications node 10 including, but not limited to, filters, oscillators, and other electronics.

Space vehicle (SV) payload 30 includes main mission computer 32 coupled to SV heartbeat (timing) computer 40 via bus 35. SV payload 30 further includes main mission communications electronics module 34 coupled to main mission computer 32 via bus 33 and to SV heartbeat computer via bus 37. Also included in SV payload 30 is SV control computer 36, which is coupled to space vehicle (SV) position and attitude module 48 via bus 47, and which is further coupled to telemetry, tracking, and control (TTAC) communications electronics module 38 via bus 49. TTAC 38 is additionally coupled to SV heartbeat computer 40 via bus 39.

SV heartbeat computer 40 is also coupled via bus 41 to at least one memory 42 that contains computer-executable instructions and data for controlling phased-array antenna 14, and which, in FIG. 2, is shown for illustrative purposes as comprising omni coefficients 43 and mission coefficients 44. It will be appreciated by one of ordinary skill in the art that other types of phased-array antenna coefficients could be stored in memory 42.

Memory 42 can take the form of any appropriate storage medium, e.g., random access memory (RAM), other semiconductor or magnetic read-write memory devices, optical disk, magnetic tape, floppy disk, hard disk, etc. It will also be understood that memory 42 can also store other variables, tables, databases, and data structures that are accessed, updated, and manipulated during the operation of satellite-based communications node 10. It will be further understood that additional memory units (not shown) can be provided in satellite-based communications node 10.

Phased-array antenna 14 includes a digital beamformer 11 that is coupled to main mission communications electronics module 34 via bus 24, to TTAC communications electronics module 38 via bus 25, and to SV heartbeat computer 40 via bus 17. Phased-array antenna 14 also includes phased-array panel 13 (also referred to herein as a "phased array"), which is coupled to digital beamformer 11 via bus 26. Phased-array antenna 14 further includes element controller 15 that is coupled to phased-array panel 13 via bus 28 and that is further coupled to SV heartbeat computer 40 via bus 17.

In one embodiment, main mission computer 32 performs functions that are related to the "main mission" of the satellite-based communications node, i.e. receiving communications signals, processing them if necessary, and transmitting them to other communications nodes within the satellite communications system. One of the functions performed by main mission computer 32, as it pertains to the present invention, is determining the particular "mission state", i.e. whether the satellite is in its ascent phase, parking orbit phase, main mission phase in its final orbit, or other phase. Main mission computer 32 determines the mission state from data stored in its memory, which data is periodically updated by on-board systems, such as TTAC communications electronics module 38, SV position and attitude module 48, and from communications received from ground terminals or from other satellites.

The particular mission state of the satellite can be used to determine the operational mode of the phased-array antenna 14. For example, during the satellite's ascent phase, the phased-array antenna 14 could operate in a mode having a beam of medium width and medium bandwidth. This mode could be used, for example, to communicate with a ground station without having to switch fixed-focus beams or to steer a focused beam towards the ground station.

By way of further examples of the operation of the satellite's phased-array antenna 14 in different modes, while the satellite is in parking orbit, the phased-array antenna 14 could be enabled to operate in a mode having a broad, low power, low bandwidth beam. While the satellite is performing its normal mission on orbit, the phased-array antenna 14 could be enabled to operate in a mode in which one or more narrow width, high bandwidth beams are pointed towards, and in some embodiments are steered towards, individual earth-based communications nodes, such as fixed or mobile wireless devices.

The main mission computer 32 additionally performs other processing and control functions as needed. SV control computer 36 performs various functions that relate to flying the space vehicle, such as controlling its attitude and orbital position.

SV position and attitude module 48 performs functions that provide position data (e.g. via a global positioning system (GPS)) and attitude data (e.g. roll, pitch, yaw, and their associated rates of change).

SV heartbeat computer 40 performs functions that control the space vehicle and antenna electronics. For example, it provides information concerning the status of the space bus power system (not shown) to main mission computer 32. Its role in controlling the mode of operation of phased-array antenna 14 will be explained further regarding FIG. 3 below.

SV heartbeat computer 40 can retrieve antenna beam data, including various beamforming coefficients, from memory 42, depending upon the desired mode of operation of phased-array antenna 14. This will be explained in greater detail below.

In one embodiment, main mission communications electronics module 34 includes various electronics equipment, such as switches, channelizers, filters, analog-to-digital (A/D) and digital-to-analog (D/A) converters, and modems. This equipment performs functions that implement the operation of phased-array antenna 14 in a "mission" mode having relatively narrow beams and relatively high data rates, to enable communications links from the satellite to subscribers using fixed or mobile wireless devices 20 (FIG. 1) and/or to terrestrial communications nodes 22 (FIG. 1). It will be appreciated by one of ordinary skill in the art that the electronics equipment of main mission communications electronics module 34 that implements the operation of phased-array antenna 14 can be integrated into the phased-array antenna 14 in other embodiments.

In one mode, TTAC communications electronics module 38 includes various electronics equipment, such as filters, A/D and D/A converters, and modems. This equipment performs functions that implement the operation of phased-array antenna 14 in a "non-mission" or "omni" mode having a medium width beam with a medium data rate, or a broad width beam with a low data rate, to enable communications links from the satellite to a terrestrial communications node 22 (FIG. 1) for the purpose of providing command, control, and telemetry communications. Such communications are typically required during the ascent and parking orbit phases, although they could also be provided during the mission phase in order to maintain the satellite in its desired orbit or to de-orbit it.

Phased-array panel 13 generates one or more phased-array antenna beams (51, 61, 62), depending upon the particular mode of operation, as well as the number of individual antenna beams that are required when operating in "mission" mode. Phased-array panel 13 includes a number of individual antenna elements or radiators. Phased-array panel 13 can also include various ancillary electronics (not illustrated), such as low noise amplifiers, power amplifiers, filters, and D/A and A/D converters, as necessary to implement a steered phased-array antenna.

The specific number of antenna elements or radiators in phased-array panel 13 depends upon the desired number of beams per "footprint" (i.e. the total antenna pattern projected upon the surface of the earth), the accuracy of the beam projections, the desired side-lobe levels, the spacing between antenna radiators, frequency of operation, and other factors.

Digital beamformer 11 performs digital signal processing functions that control the phased-array panel 13 in accordance with conventional techniques. Digital beamformer 11 can contain digital signal multipliers, phase-shifters, summers, and other components (not shown) needed to perform digital beam forming of an antenna beam. It will also be understood by one of ordinary skill in the art that an analog phased-array antenna could be substituted for the digital phased-array antenna described above, making suitable changes to the ancillary circuitry, for example, by using an analog beamformer that includes phase-shifters, attenuators, combiners, and dividers.

In one embodiment of the invention, phased-array panel 13 comprises a plurality of individual radiators to provide in-phase addition and cancellation of signals from digital beamformer 11 to produce a plurality of antenna beams. Digital beamformer 11 can provide a separate signal to phased-array panel 13 for each individual radiator.

Digital beamformer 11 also controls the phased-array panel 13 to operate in one of a plurality of different operational modes. Digital beamformer 11 and element controller 15 use antenna beam data and instructions that they receive over bus 17 from SV heartbeat computer 40 to control phased-array panel 13 to generate the proper phased-array beam pattern, depending upon the desired mode of operation (i.e. whether in "omni", "mission", or other mode), as well as upon the number of beams that should be active.

For example, digital beamformer 11 uses antenna beam data that includes antenna beam coefficients. In one embodiment, the antenna beam coefficients include phase-control and amplitude-control information. It will be understood by one of ordinary skill in the art that other types of phased-array antennas are known that utilize only phase-control information or only amplitude-control information, and it is intended that the present invention apply to any type of phased-array antenna.

Digital beamformer 11 performs different, but related functions, depending upon whether the phased-array antenna 14 is operating in transmit mode or in receive mode. In transmit mode, digital beamformer 11 provides a radio frequency (RF) signal to the antenna elements with the appropriate phase-control and/or amplitude-control information for the phased-array panel 13 to generate a coherent transmit beam. In receive mode, digital beamformer 11 applies complex weighting, in the form of appropriate phase-control and/or amplitude-control information, to the antenna elements and sums the weighted signals for the antenna elements to form a receive beam.

Element controller 15 uses antenna beam data that includes the number of phased-array antenna elements or radiators that should be activated. Element controller 15 controls the selection, activation, and weighting of the individual antenna elements that are combined to form receive or transmit antenna beams according to the desired mode of operation.

For example, when the phased-array antenna 14 is operated in "omni" or broad-beam mode, a relatively small number or subset of the full array of antenna elements is activated to form an antenna beam pattern 51 characterized by a relatively broad, diffused pattern, relatively low power, and relatively low bandwidth. In one embodiment, only one antenna element is activated in "omni" mode, which antenna element suffices to provide a relatively low power, diffused beam having a low data rate.

However, one of ordinary skill in the art will understand that using a single element or just a few elements to produce a diffused antenna pattern has the disadvantage of creating a relatively low power antenna beam, if (as is usually the case) each radiating element has its own amplifier. For this reason it may be desirable to operate with many radiating antenna elements in the diffused mode. (FIG. 4, discussed below, illustrates a broad pattern produced by a subset of elements.)

While increasing the number of radiating antenna elements increases the radiated RF power, it also increases the amount of direct current (DC) or bus power required. Selecting the optimum size of the subset of radiating antenna elements requires balancing the DC power available against the RF power required. The present invention can provide for any amount of radiating power, up to the full power that the antenna is capable of radiating, by varying the number of antenna elements that are powered on. The SV heartbeat computer can determine how many elements should be powered on, based on the phase of the mission, degree of battery charge, distance to a target antenna such as a ground station, etc.

In contrast, when phased-array antenna 14 is operated in "mission" mode, a relatively large number of antenna elements can be selected and activated to generate a plurality of focused-beam antenna beam patterns 61–64 each characterized by a relatively narrow, focused pattern, relatively high power, and relatively high bandwidth. In "mission" mode the number of antenna beams can vary from one beam to the operational maximum number of beams, depending upon the communications load. In some embodiments phased-array antenna 14 turns focused beams on and off as satellite 10 passes over a given targeted terrestrial communications node, "handing off" communications from one beam to the next, while in other embodiments phased-array antenna steers a single tracking beam towards each targeted terrestrial communications node for a relatively long period of time.

Phased-array antenna 14 can also be operated in other modes, such as a mode in which a medium number of antenna elements are activated to form one or more antenna beam patterns characterized by a medium width pattern, medium power, and medium bandwidth.

It will be understood that phased-array antenna 14 can also be operated in more than one of the above-described modes concurrently if necessary to accomplish the satellite's communications requirements. For example, an omni antenna pattern could be generated concurrently with a more focused, feeder-link beam to a ground station to provide a "make before break" transition from the omni mode to the mission mode.

It will be appreciated by one of ordinary skill in the art that the blocks shown in FIG. 2 are merely for illustrative purposes, and that the actual physical and logical configurations can be different from those shown. For example, the computational functions performed by different blocks identified as computers or controllers could be performed by a single computer or by different computational devices than those shown.

Figure 3:
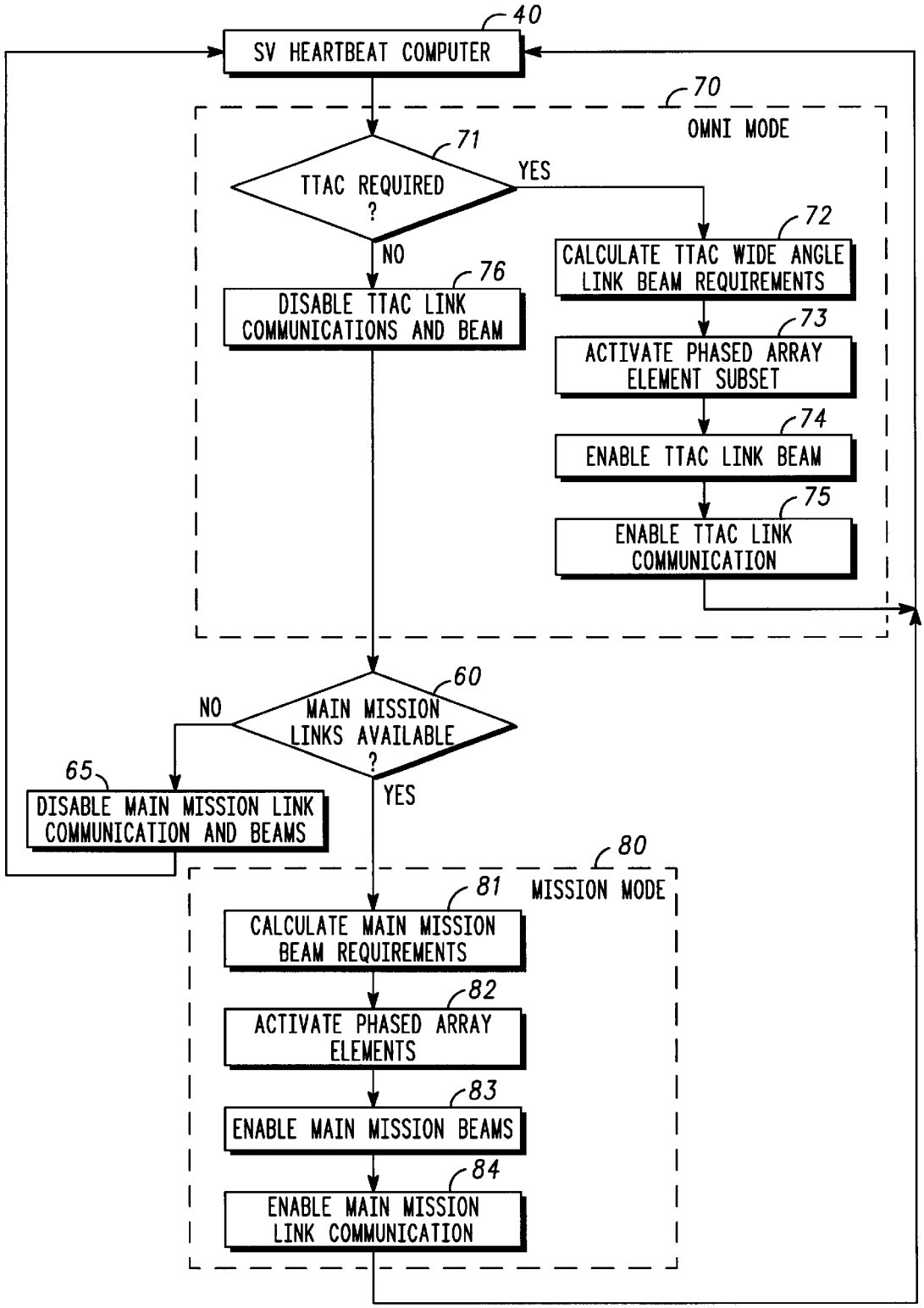
FIG. 3 depicts a flow diagram of a method of operating a satellite-based communications node, including a phased-array antenna system that operates in more than one mode, according to one embodiment of the invention.

FIG. 3 depicts a flow diagram of a method of operating a satellite-based communications node, including a phased-array antenna system that operates in more than one mode, according to one embodiment of the invention.

SV heartbeat computer 40 controls the phased-array antenna electronics, including its modes of operation.

In decision block 71 a determination is made whether the satellite needs to communicate with a ground station for the purposes of telemetry, tracking, and control (TTAC). This requirement typically occurs during the ascent phase and parking orbit phase of the satellite, but it could also occur while the satellite is in its operational orbit. Main mission computer 32 normally determines what phase the satellite is in and what its communications needs are, and it keeps SV heartbeat computer 40 informed of the mission status. If SV heartbeat computer 40 indicates that TTAC is required, the process goes to block 72; if not, it goes to block 76.

In block 76, the TTAC link communication and TTAC beam (also referred to as an "omni" beam) are disabled, and the process goes to decision block 60.

In block 72, SV heartbeat computer 40 calculates the beam requirements corresponding to a wide-angle beam to be used for a TTAC communications link. In doing so, it accesses instructions and antenna data (including data specifying the number of elements to be used and data specifying amplitude-control and phase-control) that are stored in memory 42, performs calculations, stores the results in memory 42, and also sends the results to digital beamformer 11 and to element controller 15.

In block 74, digital beamformer 11 and element controller 15 enable the desired "omni" or TTAC link beam by controlling the antenna elements in phased-array panel 13 in a manner that is well understood by those of ordinary skill in the art, and the process goes to block 75, wherein the TTAC link communications are enabled. The process next returns to block 71 via SV heartbeat computer 40.

In block 60, a determination is made whether the satellite's phased-array antenna 14 should operate in "mission" mode using some or all of its main mission antenna elements. If so, the process goes to block 81; if not, the process goes to block 65, where the main mission antenna elements, main mission beams, and main mission link communications are all disabled.

In block 81, SV heartbeat computer 40 calculates the beam requirements corresponding to a main mission mode of operation. In doing so, it accesses instructions and antenna data (including data specifying the number of elements to be used and data specifying amplitude-control and/or phase-control) that are stored in memory 42, performs calculations, stores the results in memory 42, and also sends the results to digital beamformer 11 and to element controller 15.

Next, in block 82, the number of phased-array elements required to support the main mission are activated. This could be all or a subset of the elements comprising phased-array panel 13, depending upon the current communications load.

In block 83, digital beamformer 11 and element controller 15 enable the one or more desired "main mission" link beams by controlling the antenna elements in phased-array panel 13 in a manner that is well understood by those of ordinary skill in the art, and the process goes to block 84, wherein the main mission link communications are enabled. The process next returns to block 71 via SV heartbeat computer 40.

It will be understood by those skilled in the art that the steps of the methods shown and described herein can be carried out in a different order than those described with reference to FIG. 3.

With reference to FIGS. 2 and 3, it will be seen that the contents of memory 42 represent data structures stored in a computer-readable medium. The data structures comprise various antenna beam data for controlling phased-array antenna 14. Such antenna beam data can include antenna beam coefficients that apply phase-control and amplitude-control information, as well as data that indicates the number of phased-array antenna elements or radiators that should be activated in phased-array panel 13. It will be understood by one of ordinary skill in the art that other types of phased-array antennas are known that utilize only phase-control information or only amplitude-control information, and it is intended that the present invention apply to any type of phased-array antenna. Thus the data structures stored in memory 42 can include antenna beam coefficients that apply just phase-control information or just amplitude-control information, as well as those that apply both phase-control and amplitude-control information.

A computer-readable medium (e.g., memory 42) comprises a first block of data stored in a first region of memory addresses in the medium. The first block comprises antenna data that control phased-array antenna 14 operating in a first mode, e.g. in "omni" mode, wherein a relatively small number or subset of antenna elements are selected for operation of phased-array antenna 14 as a diffused-beam antenna, enabling satellite-based communications node 10 to communicate with a terrestrial communications node via a communications channel having relatively low bandwidth. This data block can further include data sub-blocks each associated with a different subset or number of powered radiating antenna elements. In this case the SV heartbeat computer 40 decides the amount of radiated power desired and selects the appropriate sub-block of data.

The first block can also include phase-control and amplitude-control information which is applied to the selected antenna elements in phased-array panel 14 by digital beamformer 11. In other embodiments, the first data block can include just phase-control information or just amplitude-control information.

The medium further comprises a second block of data stored in a second region of memory addresses in the medium. The second block comprises antenna data that control phased-array antenna 14 operating in a second mode, e.g. in "mission" mode, wherein a relatively large number of antenna elements are selected for operation of phased-array antenna 14 to potentially generate a plurality of focused-beam antenna patterns, enabling satellite-based communications node 10 to communicate with a terrestrial communications node via a communications channel having relatively high bandwidth using one of the plurality of focused-beam antenna patterns.

The second block can also include phase-control and amplitude-control information which is applied to the selected number of antenna elements in phased-array panel 14 by digital beamformer 11. In other embodiments, the second data block can include just phase-control information or just amplitude-control information.

By storing at least first and second blocks of data, and additional sub-blocks of data, if desired, including antenna data, in memory 42, the spacecraft can readily switch modes by having SV heartbeat computer 40 retrieve the appropriate blocks or sub-blocks of data.

Figure 4:
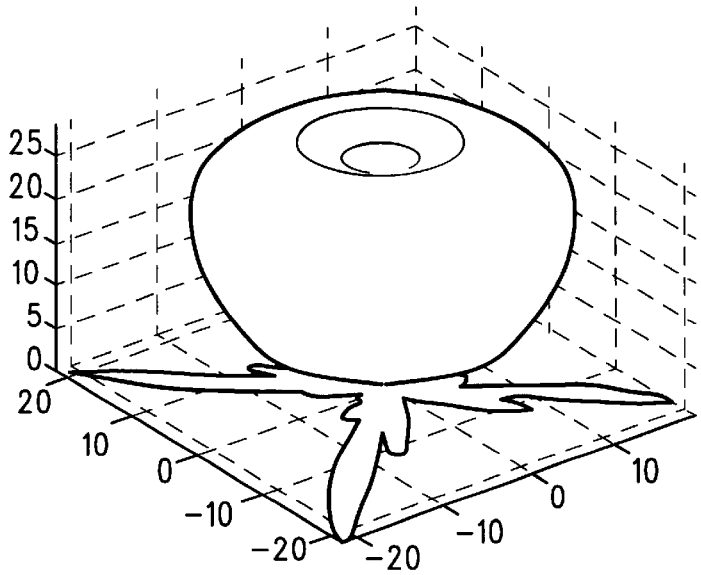
FIG. 4 depicts a phased-array antenna beam pattern for a mode when the antenna is operated as a diffused-beam antenna at a relatively low data rate.

FIG. 4 depicts a phased-array antenna beam pattern for a mode when the antenna is operated as a diffused-beam antenna at a relatively low data rate. The diffuse "donut" shaped antenna beam pattern shown in FIG. 4 was generated using one embodiment of a phased-array antenna using a subset of 19 antenna elements out of a total of 160 antenna elements. The antenna beam pattern shown in FIG. 4 can be used, for example, in communications with the satellite when communicating with a ground station in the ascent phase of the satellite, when the satellite's precise position is unknown.

Figure 7:
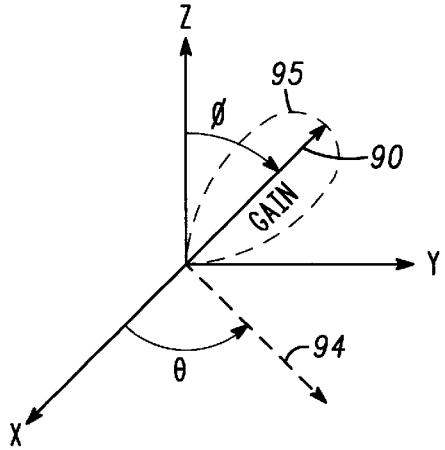
FIG. 7 depicts a set of spherical coordinates used in describing the antenna beam patterns illustrated in FIGS. 4–6.
Figure 5:
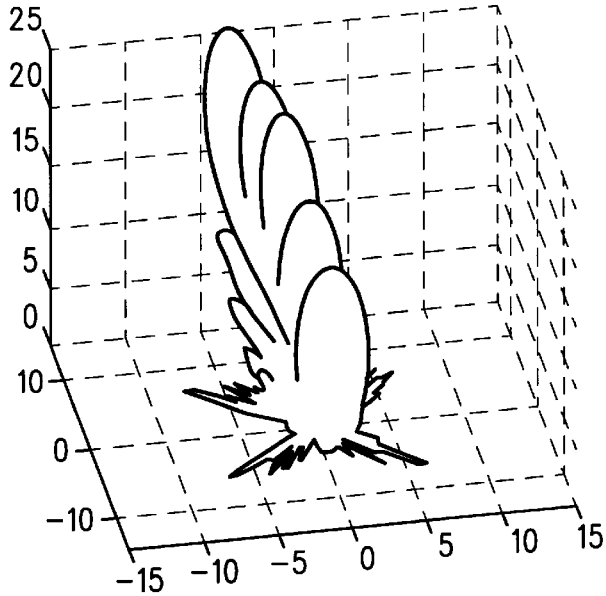
FIG. 5 depicts a phased-array antenna beam pattern for a mode when the antenna is operated as a partially focused-beam antenna at a medium data rate.
Figure 6:
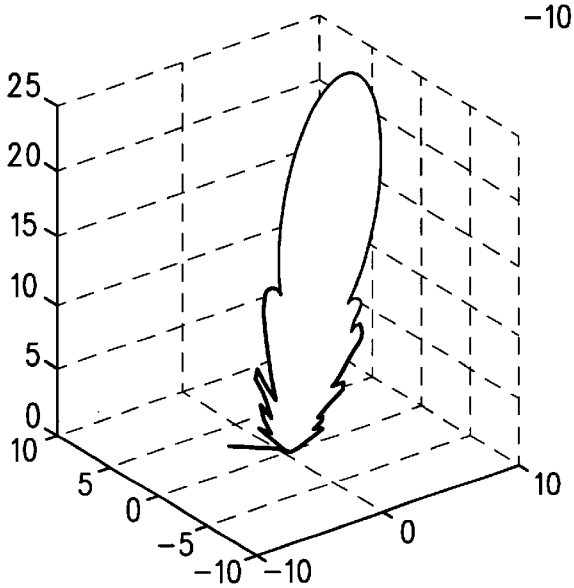
FIG. 6 depicts a phased-array antenna beam pattern for a mode when the antenna is operated as a highly focused-beam antenna at a relatively high data rate.

The plot shown in FIG. 4 is better understood by referring to FIG. 7, which depicts a set of spherical coordinates used in describing the spatial orientation of the antenna beam patterns illustrated in FIGS. 4–6.

In FIG. 7 the spherical coordinates are superimposed on a set of Cartesian coordinates X, Y, and Z. The spherical coordinates include radius r (which is shown co-linear with the gain vector 90 of the antenna beam pattern) emanating at the origin of the Cartesian coordinates; an azimuthal angle $\theta$ representing the angle between the X-axis and the projection 94 of the radius r on the X/Y plane; and a polar angle $\phi$ (also referred to as an elevation angle) representing the angle between the Z-axis and the radius r.

The plot of FIG. 4 shows relative antenna gain 90 of an antenna beam pattern 95 as a function of azimuth $\theta$ and elevation $\phi$.

FIG. 5 depicts a phased-array antenna beam pattern for a mode when the antenna is operated as a medium focused-beam antenna at a medium data rate. The long and narrow ridge-shaped antenna beam pattern shown in FIG. 5 was generated using one embodiment of a phased-array antenna using a subset of 93 antenna elements out of a total of 160 antenna elements. The antenna beam pattern shown in FIG. 5 can be used, for example, in communications with the satellite when communicating with a ground station whose location lies within the sweep of the satellite's footprint as it moves over the earth's surface.

FIG. 6 depicts a phased-array antenna beam pattern for a mode when the antenna is operated as a highly focused-beam antenna at a relatively high data rate. The narrow, focused antenna beam pattern shown in FIG. 5 was generated using one embodiment of a phased-array antenna using a total of 160 antenna elements. The antenna beam pattern shown in FIG. 6 can be used, for example, in communications with the satellite when communicating with a ground-based communications node, such as a fixed or mobile wireless device, in "mission" mode.

Conclusion

Thus there have been described above apparatus and methods for providing a communications node, and in particular a satellite-based communications node, having one or more phased-array antennas that can operate in a plurality of modes and that can communicate with different types of communications nodes, wherever located.

Using a single antenna type to communicate in different modes on-board a spacecraft provides the advantages of decreasing complexity, weight, volume, and power consumption. In addition, it lowers the cost and time to design, construct and/or purchase, integrate, test, launch, and maintain the satellite, and it increases the satellite's reliability in several ways, e.g. by eliminating reliance upon a mechanical switch to mechanically switch between different types of on-board antennas. Any failure of individual phased-array radiating elements would not necessarily result in total loss of the satellite, as would the failure of an omni antenna, because both omni and mission communications functions could be performed with a subset of working antenna elements. In addition, the apparatus and methods of the present invention reduce the layout problems that result in one antenna on the satellite blocking communications being conducted through another antenna on the satellite.

Thus a satellite communications system employing the apparatus and methods of the present invention has a greater potential for efficient and cost-effective satellite implementation.

While the invention has been described in terms of specific examples, it is evident that many alternatives and variations will be apparent to those skilled in the art based on the description herein, and it is intended to include such variations and alternatives in the claims.

What is claimed is:

1. A method of operating a satellite-based communications node having a phased-array antenna that operates in one of a plurality of modes, the phased-array antenna comprising a computer and a beamformer, the method comprising:

the computer determining a desired mode of operation;

the computer applying antenna data to the beamformer to cause the phased-array antenna to operate in the desired mode of operation;

the computer selecting and weighting antenna elements using the antenna data;

the phased-array antenna is operated as a diffused-beam antenna;

the phased-array antenna is operated to generate a plurality of focused-beam antenna patterns;

the number of antenna elements selected is any subset, including a subset of just one antenna element, of the plurality of antenna elements, and wherein the antenna data applied to the beamformer includes appropriate amplitude-control information, or phase-control information, or both amplitude-control and phase-control information, to provide a diffused-beam antenna pattern; and the satellite-communications node is enabled to communicate with a terrestrial communications node via a communications channel having a relatively low bandwidth.

2. The method recited in claim 1 wherein the phased-array antenna is operated to generate a plurality of focused-beam antenna patterns.

3. The method recited in claim 1 wherein the phased-array antenna is operated to generate a plurality of focused-beam antenna patterns if a relatively large number of antenna elements is selected, and wherein the antenna data applied to the beamformer includes appropriate amplitude-control information, or phase-control information, or both amplitude-control and phase-control information, to generate the plurality of focused-beam antenna patterns.

4. A satellite-based communications node which is adapted to communicate with at least two terrestrial communications nodes in a satellite communications system, the satellite-based communications node comprising:

a phased-array antenna that communicates with a first one of the at least two terrestrial communications nodes in a first mode of operation and that communicates with a second one of the at least two terrestrial communications nodes in a second mode of operation, the phased-array antenna comprising a plurality of elements;

the phased-array antenna operates in the first and second modes of operation concurrently;

an element controller coupled to the phased-array antenna, the element controller controlling the phased-array antenna to cause it to operate in the first mode of operation and the second mode of operation through the selection by the element controller of a corresponding number of the plurality of elements;

a memory that stores computer-executable instructions and data, including phased-array antenna data;

wherein the element controller comprises a processor coupled to the memory, the processor executing computer-executable instructions stored in the memory and retrieving data from the memory, the processor controlling the phased-array antenna by selecting the corresponding number of the plurality of elements in response to the processor retrieving corresponding phased-array antenna data from the memory;

wherein in the first mode of operation the phased-array antenna operates as a diffused-beam antenna;

wherein in the first mode of operation the satellite-communications node is enabled to communicate with a first one of the at least two terrestrial communications nodes via a communications channel having a relatively low bandwidth;

wherein in the second mode of operation the phased-array antenna operates to generate a plurality of focused-beam antenna patterns; and wherein in the second mode of operation the satellite-communications node is enabled to communicate with a second one of the at least two terrestrial communications nodes via a communications channel having a relatively high bandwidth using one of the plurality of focused-beam antenna patterns.

5. The satellite-based communications node recited in claim 4 wherein the phased-array antenna data additionally comprises phase-control information.

6. The satellite-based communications node recited in claim 4 wherein the phased-array antenna data additionally comprises amplitude-control information.

7. A computer-readable medium having stored thereon a data structure, comprising:

a first block of data stored in a first region of memory addresses in the medium, the first block comprising a first plurality of antenna data that control a phased-array antenna operating in a first mode;

a second block of data stored in a second region of memory addresses in the medium, the second block comprising a second plurality of antenna data that control a phased-array antenna operating in a second mode; and wherein the first and second pluralities of antenna data control the selection of antenna elements of the phased-array antenna and the application of phase-control information, or amplitude-control information, or both phase-control and amplitude-control information, to the selected antenna elements, the first plurality of antenna data selecting a subset of antenna elements and applying appropriate phase-control information, or amplitude-control information, or both phase-control and amplitude-control information, to the subset of antenna elements for operation of the phased-array antenna as a diffused-beam antenna, and the second plurality of antenna data selecting a relatively large number of antenna elements and applying appropriate phase-control information, or amplitude-control information, or both phase-control and amplitude-control information, to the number of antenna elements for operation of the phased-array antenna to generate a plurality of focused-beam antenna patterns.

8. The computer-readable medium recited in claim 7 wherein the first and second pluralities of antenna data additionally comprise phase-control information.

9. The computer-readable medium recited in claim 7 wherein the first and second pluralities of antenna data additionally comprise amplitude-control information.

10. A computer-readable medium having stored thereon a data structure for use in controlling a satellite-based communications node having a phased-array antenna that operates in a plurality of modes, the computer-readable medium comprising:

a first block of data stored in a first region of memory addresses in the medium, the first block comprising a first plurality of antenna data that control the phased-array antenna operating in a first mode;

a second block of data stored in a second region of memory addresses in the medium, the second block comprising a second plurality of antenna data that control the phased-array antenna operating in a second mode; and wherein the first and second pluralities of antenna data control the selection of antenna elements of the phased-array antenna and the application of phase-control information, or amplitude-control information, or both phase-control and amplitude-control information, to the selected antenna elements, the first plurality of antenna data selecting a subset of antenna elements and applying appropriate phase-control information, or amplitude-control information, or both phase-control and amplitude-control information, to the subset of antenna elements for operation of the phased-array antenna as a diffused-beam antenna, enabling the satellite-based communications node to communicate with a terrestrial communications node via a communications channel having relatively low bandwidth, and the second plurality of antenna data selecting a relatively large number of antenna elements and applying appropriate phase-control information, or amplitude-control information, or both phase-control and amplitude-control information, to the number of antenna elements for operation of the phased-array antenna to generate a plurality of focused-beam antenna patterns, enabling the satellite-based communications node to communicate with a terrestrial communications node via a communications channel having relatively high bandwidth using one of the plurality of focused-beam antenna patterns.

11. The computer-readable medium recited in claim 10 wherein the first and second pluralities of antenna data additionally comprise phase-control information.

12. The computer-readable medium recited in claim 10 wherein the first and second pluralities of antenna data additionally comprise amplitude-control information.

* * * * *